United States Patent [19]

Owens

[11] 4,433,800

[45] Feb. 28, 1984

[54] POURING FITMENT AND CLOSURE ASSEMBLY

[75] Inventor: Edward W. Owens, Tucson, Ariz.

[73] Assignee: Top-Seal Corporation, Tempe, Ariz.

[21] Appl. No.: 334,322

[22] Filed: Dec. 24, 1981

[51] Int. Cl.[3] ..... B65D 25/40

[52] U.S. Cl. ..... 222/547; 222/564; 222/570; 222/571; 222/111

[58] Field of Search ..... 222/547, 564, 567, 571, 222/111, 570

[56] References Cited

U.S. PATENT DOCUMENTS 3,980,211 9/1976 Owens ..... 222/547 X

*Primary Examiner*—David A. Scherbel

*Assistant Examiner*—Russell D. Stormer

*Attorney, Agent, or Firm*—LaValle D. Ptak

[57] ABSTRACT

A pouring fitment and closure assembly comprising a central tubular body having at its interior most extremity an enlarged circular disk-like plate with a sharpened edge, the central tubular portion then opening up into a rib-formed plurality of ports to an interior plenum terminated at the outside end by an annular inwarldy protruding sharpened projection interior to the plenum forming a first sharp dripless and sealing edge. The central tubular body flairs outward in a skirt to join a flat annular radial sealing ring at its top which in turn terminates in a larger circular edge to form an acute angle, the second dripless edge.

17 Claims, 5 Drawing Figures

POURING FITMENT AND CLOSURE ASSEMBLY

BACKGROUND OF THE INVENTION

With the increased production and marketing of containers of liquids in which it is desirable that the liquid be removed from the container in relatively small amounts, it is advantageous when the container itself provides the liquid at a measured and substantially constant flow rate, free of surges in the liquid coming from the container and also free of interruptions in the flow. These objects have been accomplished to some extent by a number of devices adapted to reside in or near the opening of the containers and have been characterized as pouring fitments, pouring devices and insert members of bottles, drip-preventing devices for bottles, drop dispensers, and pouring adaptor-closure assemblies such as has been shown in U.S. Pat. Nos. 3,098,586 (Wasserberg), 3,628,697 (Dowson), 3,543,973 (Berins), and 3,980,211 (Owens).

The devices which are presently available to accomplish the aforestated purposes suffer shortcomings which do not make them readily adaptable for mass production capping methods since in fitting the anti-surge or dripless elements to the liquid containers it is necessary for an operator to place and fit the element to the top of the container after the container has been filled with its liquid and then in a separate step, to place the closure upon the container, screwing it down upon threads formed in the neck of the container, and in the closure. As such, this is at least a two-step operation.

There have been some improvements made in the anti-surge and dripless elements of others whereupon the element, prior to installation upon a container, is first fit into a closure whereupon the closure then is placed upon the container neck opening. This results in a one-step operation which is much faster, except however, the prior devices known to the Applicant are characterized as being rather elongated which means that when they are placed in the closure prior to capping, the central portion rises above the outside edge of the closure. As a consequence, the combination does not present itself readily adaptable to automatic capping machinery as, invariably, the center of gravity of the closure and anti-surge and dripless element combined rises to a point near or above the cylindrical wall of the closure, thus being somewhat prone to tipping and subject to misalignment or failing to function well in the automatic capping machine. In addition, if the anti-surge dripless element extends substantially above the cylindrical wall of the closure, there is always the opportunity that the element may not be seated properly by the capping machinery.

This problem is especially accentuated with the increasing use of the short profile closures now being utilized for capping containers because of their adaptability to the automatic capping machinery.

As a consequence of the need to develop a pouring fitment and closure assembly having a low profile, yet still possessing the advantages of being dripless, presenting a continuous stream of liquid at a measured rate and without surges, or gurgling, of the liquid as it exits the container opening, as well as being readily adaptable to the automatic capping machinery now using the closures having shortened cylindrical walls, it is apparent that there is economic value in improvements in this field.

Accordingly, there is a need for a pouring fitment having a low profile, which when placed in a a short cylindrical wall closure, does not protrude above the wall of the closure, or in the alternative, protrudes very little above the wall of the closure in order to facilitate the capping operation, yet possess the characteristics necessary for desirable pouring of liquids from a container.

SUMMARY OF THE INVENTION

The present invention comprises a low profile pouring fitment and closure assembly, the pouring fitment adapted to be placed and reside in the closure assembly prior to the automatic capping operation. More specifically, the subject invention comprises a central tubular body adapted to reside interiorly to the neck of the container, the central tubular body which sets interiormost in the container characterized by a closed circular end plate having a sharp peripheral edge about which the liquid must pass, the combination serving to induce turbulance into the liquid's flow. After the liquid has passed between the peripheral edge and the side of the container, it enters one or more of a plurality of central ports past an anti-splash skirt into the plenum interiorly to the central tubular body. The central tubular body cylinder interior wall has near its outside end an annular inwardly protruding projection, the underside of which forming an annular groove adapted to receive liquid from the port opposite to produce a puddling effect and thereby reduce again the velocity of the flowing liquid. The annular inwardly protruding projection forms a first dripless edge with the tip of the projection continuing upward and out of the central tubular body with an outward flared skirt, terminating in a flat annular radial sealing ring.

The flat radial annular ring then terminates at its outer peripheral edge in a second sharp dripless edge formed as the central tubular body cylindrical wall continues down on its outside to an annular well formed by the exterior of the central tubular body cylindrical wall and a first radially extending flange, the well adapted to receive liquid from the second sharp dripless edge and hold the liquid there for containment purposes and/or evaporation. The annular well continues upward and radially outward from the first radially extending flange into an offset second radially extending flange adapted to encompass the circular top portion of the container whereupon a depending cylindrical skirt drops downward on the container neck with an inwardly projecting annular bead adapted to nest within a groove formed near the top of the container outside wall to hold the pouring fitment in place. The second radially extending flange continues outward beyond the depending cylindrical skirt to form a plurality of outwardly directed sharpened lugs adapted to reside underneath an inwardly directed circular retaining bead formed on the closure cylindrical wall proximate its interior circular base.

The closure utilized with the pouring fitment is characterized by an interior cylindrical wall inwardly directed bead to contain the pouring fitment within the closure. In addition, interiorly to the circular bottom area of the closure is a centrally located outwardly directed protruding first annular ring adapted to engage the flared skirt and annular inwardly protruding projection (first sharp dripless edge) of the pouring fitment in a sealing arrangement. Immediately next to the outwardly directed protruding annular ring is an annular groove which receives the flat transverse radial annular ring of the pouring fitment. Finally, concentrically outwardly of the annular groove is a second annular outwardly directed protruding ring to seal against the pouring fitment second radially extending flange when the closure is finally capped upon the container.

The pouring fitment, being flexible, is deposited in the closure assembly with its plurality of outwardly directed lugs pushed below the inwardly directed retainer bead of the closure. At this point, the pouring fitment is encompassed by all parts of the closure and the closure is ready for the automatic capping machinery. Upon capping and as the closure is screwed down upon the bottle neck in accordance with threads formed into the bottle neck and the closure, downward pressure upon the pouring fitment causes the pouring fitment inwardly projecting annular bead of the depending cylindrical skirt to ride over the top annular ring of the container. With continued pressure exerted on the pouring fitment by continued twisting of the closure, the inwardly projecting annular bead of the pouring fitment engages the annular groove formed in the outside neck of the container. Still twisting the closure onto the bottle top, the upward protruding annular ring formed in the central circular depression of the closure engages the flared skirt of the central tubular portion of the pouring fitment, pushing the cylindrical wall in a direction transverse to the direction the closure is moving and thus effecting a seal between the upward protruding annular shaped ring and the first sharpened edge, as well as the pouring fitment flared skirt and the sloping outside wall of the annular shaped ring. In addition, a seal is formed between the flat radial annular ring and the annular groove formed in the central circular area. Finally, as the closure is screwed to its final resting place, a fourth seal is formed between a second outwardly directed protruding annular ring in the base of the closure and the second radial extending flange.

Accordingly, it is an object of the present invention to provide a pouring fitment which has a profile adaptable for mass production methods of capping containers with closures.

It is another object of the present invention to provide apparatus whereby liquid pouring velocity from a container is further reduced to provide a continuing and steady stream of liquid.

It is still another object of the present invention to provide a means where a pair of dripless edges formed in a pouring fitment assure no drip from a container as the container completes its operation.

It is still further object of the present invention to provide means to receive liquids which would otherwise drip from the container and to hold the liquids in place for evaporation or eventual containment.

DETAILED DESCRIPTION OF THE PREFERRED EMBODIMENT

Figure 1:
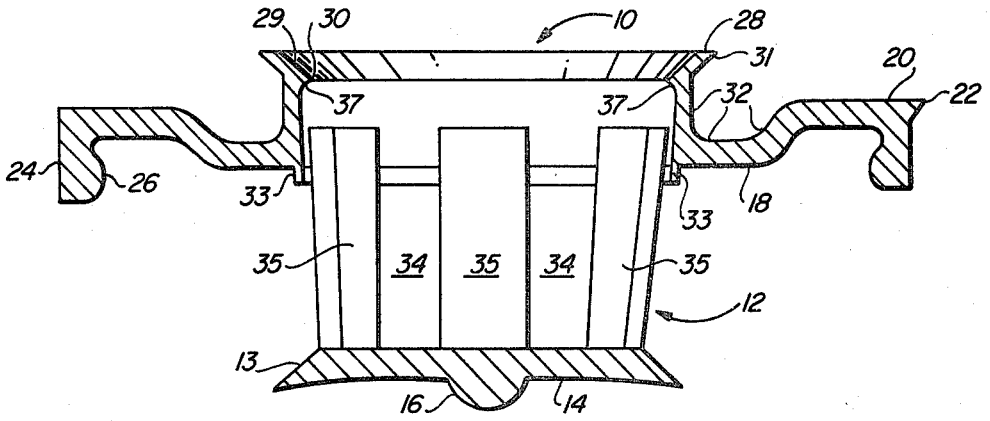
FIG. 1 is a sectional elevational view of the inventive pouring fitment.

Referring now to FIG. 1, an elevational sectional view of the pouring fitment 10 is shown in detail. For ease of description in FIG. 1, the container, the neck of which receives the pouring fitment, is not shown nor is the closure assembly which screws down upon the container and encompasses the pouring fitment. Both of these are disclosed in later figures.

The pouring fitment 10 is characterized by a central tubular body 12 which is adapted to reside interiorly to the neck opening of the container. In the position shown, the pouring fitment 10 is situated as if the container were upright, i.e., not in a pouring position. Terminating the end of the central tubular body 12 which would be located interiormost to a container is end plate 14 which is a circular solid disk having a slightly cupped end. Centrally to the circular cupped end plate 14 is a gate mark 16, nominally the portion formed by the entering plastic into the ejection mold.

Central tubular body 12 comprises, in its center area, a plurality of vertical posts or ribs, the posts connecting the upper section (later described) to the circular end plate 14 lower section, the circular end plate 14 characterized by an outwardly directed beveled or chamfer wall 13 to form a sharp circular acute angle edge with the cupped outward face of circular end plate 14. Nominally, wall 13 is at a 45° angle with the lower circular surface of end plate 14.

Ports 34 are formed by the openings between the upright posts of the center section of central tubular body 12, the ports adapted to allow the entrance of liquid into the central plenum formed interiorly to the central tubular body 12.

Continuing, the upper section of the central tubular body 12 connects with the means attaching the central tubular body to the container opening comprising a first inner radially extending annular flange 18 which, after a short distance, continues into an offset second outer radially extending annular flange 20. Second outer radially extending annular flange 20 has at its terminus a plurality of outwardly directed sharpened lugs 22. At right angles to second radially extending flange 20 is depending cylindrical skirt 24 which has, at its point distal from second radially extending flange 20, inwardly projecting annular bead 26.

Additionally, extending downwardly from flange 18 is circular anti-splash skirt 33 which attaches to the upper portions of posts 35. The interior cylindrical surface of skirt 33 extends smoothly up into the upper cylindrical portion of pouring fitment 10.

Central tubular body 12 then extends upward beyond the first radially extending flange 18 to form at its end a flat circular washer-like ring termed transverse radial annular ring 28, its flat surface parallel with circular end plate 14. At the exterior edge of flat annular ring 28 is a sharpened annular dripless edge 31, which is situated immediately above annular well 32 later described. At the interior diameter wall of central tubular body 12 and joining transverse radial annular ring 28 face is formed an inwardly flared skirt 29, which terminates opposite transverse radial annular ring 28 in a first sharp dripless edge 30, nominally an annular inwardly directed protruding projection. Immediately below sharpened dripless edge 30 and comprising a part of the inwardly directed protrusion is annular fillet 37 designed to receive and puddle liquid from ports 34.

Formed between the central tubular body 12 outside cylindrical wall and first radially extending flange 18 is annular well 32. In completing the forming of the sides of annular well 32, the exterior cylindrical wall of tubular body 12 forms the inside of well 32.

Rounding out the outer portion of annular well 32 is a ring of material connecting in an offset configuration first radially extending flange 18 to second radially extending flange 20.

Figure 2:
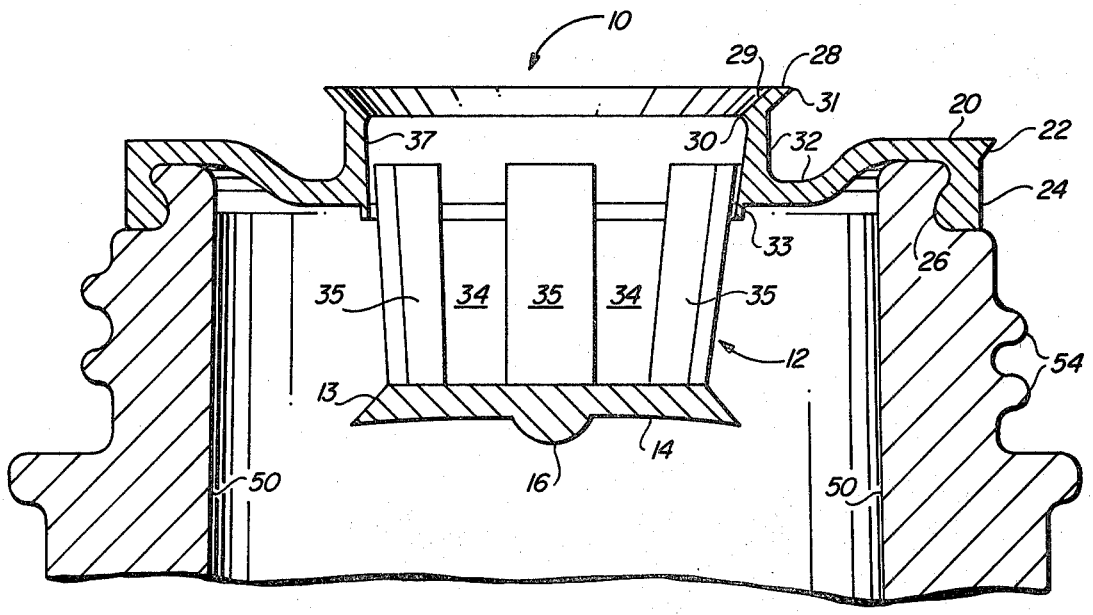
FIG. 2 is a sectional elevational view of the inventive pouring fitment in place on the neck of a container.

The function of elements identified in FIG. 1 is more clearly shown in FIG. 2, which shows the relationship between pouring fitment 10 and the liquid container.

Referring now to FIG. 2, a sectional elevational view of the inventive pouring fitment 10 in place on the neck of a bottle-type container 50 is detailed. Here the container is shown in its upright position. Most readily seen is the relationship of the bottom side of the second radially extending flange 20 encompassing the very top ring-like edge of container 50, the exterior depending cylindrical skirt 24 encompassing a short portion of the cylindrical wall of container 50, and finally the inwardly projecting annular bead 26 of pouring fitment 10 engaging a complementary annular groove formed in the container exterior cylindrical surface proximate the top of bottle container 50. This co-action of the inwardly projecting annular bead 26 and its responding container annular groove secures pouring fitment 10 in place on top of the container 50.

The bottle container 50 screw threads 54 are shown immediately below exterior depending cylindrical skirt 24 of pouring fitment 10 and, it will be noted, for obvious reasons, threads 54 extend beyond and have a greater diameter than does the outwardly directed sharpened lugs 22 of pouring fitment 10.

In operation, the inventive pouring fitment functions as follows. From an upright position, the container is tipped until the liquid level reaches the neck and pouring fitment 10. The liquid will begin to rush along one side of the container neck to pouring fitment 10, first meeting the beveled sharp edge peripheral of circular end plate 14. The liquid is restricted to movement between the sharp edge of circular end plate 14 and the side of container 50. This impedance to the flow of liquid, a baffle if you will, will cause turbulance in the fluid and substantially interrupt surging of the liquid out of the container. Thereafter, the liquid gains additional turbulance passing through the ports 34 between the upright posts, end plate 14, and circular anti-splash skirt 33, there being six equally positioned ports around central tubular body 12 in the preferred embodiment. Because the liquid still gains velocity passing around the circular end plate 14 and through the ports 34, the liquid will continue to flow to a point opposite the ports and there engage annular fillet 37 situated at the lower part of annular inwardly protruding projection dripless edge 30 formed in the outlet end portion of the pouring fitment. This annular fillet 37 causes the liquid to puddle and interrupt a straight-through flow. The slowing of the liquid tends to restrict the volume of liquid flowing. The liquid then will move over annular projecting dripless edge 30 along flared skirt 29 and over the transverse radial annular ring 28 and, depending upon the relative angle position of the container, will exit the second sharp dripless edge 31. The combination of the restrictive circular end plate 14 and the wall of the container, port 34, circular anti-splash skirt 33, annular projection 30, and annular fillet 37, together with air entering the container through pouring fitment 10 around the flowing liquid contribute to provide the continuous flow at a desired reduced volume of the liquid from the container.

Air is permitted to enter the pouring fitment about the liquid running through since the liquid will not be occupying the whole outlet of the pouring fitment. Air enters because it is believed that in the container the hydrostatic pressure at the point of the upper part of port 34 is less than the hydrostatic pressure at the port through which the liquid is pouring and thus air continues to enter the container to replace the fluid which has exited the container.

After the pouring of the liquid from the container is completed, the operator then will proceed to bring the container back to an upright position. When this happens, the container and pouring fitment will be in a position much as shown in FIG. 2. In the process of righting the container, as the liquid level begins to proceed towards the lower portion of the container, eventually no liquid will be available at the pouring fitment. At this time it is desired that the pouring fitment should render the container as dripless, and in the subject pouring fitment, such function is accomplished through means of the sharp circular edge 31 formed at the outer periphery of of the transverse radial annular ring 28 at the top-most part of the pouring fitment in an upright position. Since the edge is sharp, no drop will remain there, but in fact will be shed and will retreat into annular well 32. That liquid which retreats interiorly into the pouring fitment via flared skirt 29 will continue onto the first dripless edge 30 and thereafter will be shed into the central plenum of the central tubular body 12. Annular well 32 captures and holds for evaporation or containment by eventual closure capping the liquid retreating from the outside circular peripheral second dripless edge of the transverse radial annular ring 28.

As a consequence, any liquid which might attempt to drip off the pouring fitment, such as from the outwardly directed lugs 22, will however, never reach that point as it will be captured and held by annular well 32.

Figure 3:
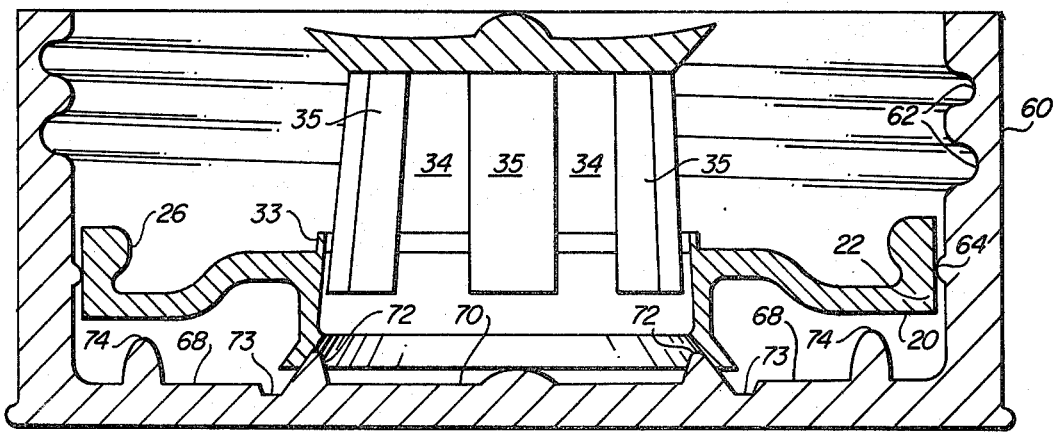
FIG. 3 is a sectional elevational view of the inventive pouring fitment situated within the inventive closure assembly.

Referring now to FIG. 3, an elevational sectional view of the invention in place in a closure, i.e., cup-like container cap or bottle cap, is detailed.

Immediately seen are the closure threads 62 which are formed in the interior of the cylindrical wall of the closure 60. At least two complete turns of threads are suggested to insure adequate tightening of closure 60 to container 50 (FIG. 2). Proceeding downward from threads 62, the cylindrical wall of closure 60 narrows to form the inwardly directed annular retainer bead 64 which has the smallest circular diameter of the interior cylindrical surface of closure 60. Bead 64 is slightly smaller in diameter than the exterior diameter of the outwardly directed lugs 22 of pouring fitment 10 (pouring fitment 10 is constructed of flexible plastic in the preferred embodiment).

Thereafter, the closure 60 cylindrical wall continues downward until it reaches the circular bottom 68 of closure 60. Formed in the center of the inside portion of bottom 68 is a circular area 70 which has centrally located an upward protruding annular shaped ring 72. This annular shaped ring is so dimensioned that its outward and upward sloping surface engages flared skirt 29 of the pouring fitment 10 (FIG. 1). Since the pouring fitment will be made from materials which have flexibility, such as plastic, it is possible to deflect outward the flared skirt 29 wall of the ouring fitment 10 as the closure is urged against the pouring fitment when the closure is tightened down over the container. Immediately outside annular ring 72 is annular groove 73 which is formed on one side by the sloped wall falling from the annular ring. The other side of the annular groove 73 rises to meet the central circular area of the bottom of the closure. Lastly, an outer second annular ring 74 is situated with the circular area 70 in the interior end cap 68. Outer second annular ring 74 is situated directly in alignment below second radially extending flange 20 of the pouring fitment. Central to the center area is the gate mark which has the same purpose as does the gate-mark of the pouring fitment.

In practice, and in adapting for production line insertion of the pouring fitment into the neck of a bottle container or other type container, the pouring fitment 10 is firstly inserted interiorly to a closure 60 to the point where the plurality of outwardly directed lugs 22 of the pouring fitment are forced down and over the retainer bead 64 formed in the closure. The pouring fitment, being made of flexible material, deforms sufficiently inward for the lugs 22 to ride over the retainer bead 64 to reside below the retainer bead 64. At this point, the pouring fitment 10 will start to resist continued further downward movement because the upward protruding annular shaped ring 72 formed in closure 60 will begin to engage the flared skirt 29 of pouring fitment 10 and some level will be found of the pouring fitment 10 within closure 60. This level will still be at a point where the outwardly directed lugs 22 of the pouring fitment reside under the bead 64.

Once the pouring fitment has been installed into the closure, the operation is now ready for installation of the pouring fitment into the neck of the container. This is accomplished merely by up-ending the closure 60 over the neck of the container and then screwing down, utilizing the threads 62 of the closure 60 as well as the threads 54 of the container 50 (FIG. 2) until the closure 60 is completely tightened down. When this happens, pouring fitment 10 is urged against protruding annular shaped ring 72. At the same time, the inwardly projecting annular bead 26 of pouring fitment 10 encompasses the top outward surface of container 50. The annular bead 26 is deflected outwardly and around the very top outside edge of container 50 which, with continued closing motion, will then move into the annular groove which is formed in the top portion of the neck of container 50. At this point, the pouring fitment 10 has been secured upon the neck of the container 50 and resists removal thereafter.

Continued screwing down of the closure 60 upon the container 50 then spreads flared skirt 29 of the cylindrical wall of pouring fitment 10 due to the engagement of the upward protruding annular shaped ring 72. Finally, annular ring 72 will ride past flared skirt 29 and engage annular projection (first sharp dripless edge) 30. At the same time, flat annular radial sealing ring 28 begins to engage the bottom portion of the circular groove 73 immediately outside and past annular ring 72. A seal is thus being formed between radial sealing ring 28 and circular groove 73, as is a seal formed between annular ring 72 and annular projection 30. In addition, flared skirt 29 will begin to press against, also in a sealing manner, the outside sloped wall of annular shaped ring 74. Lastly, a fourth seal is being formed as second annular ring 74 is forced down upon the top of second radially extending flange 20.

Figure 4:
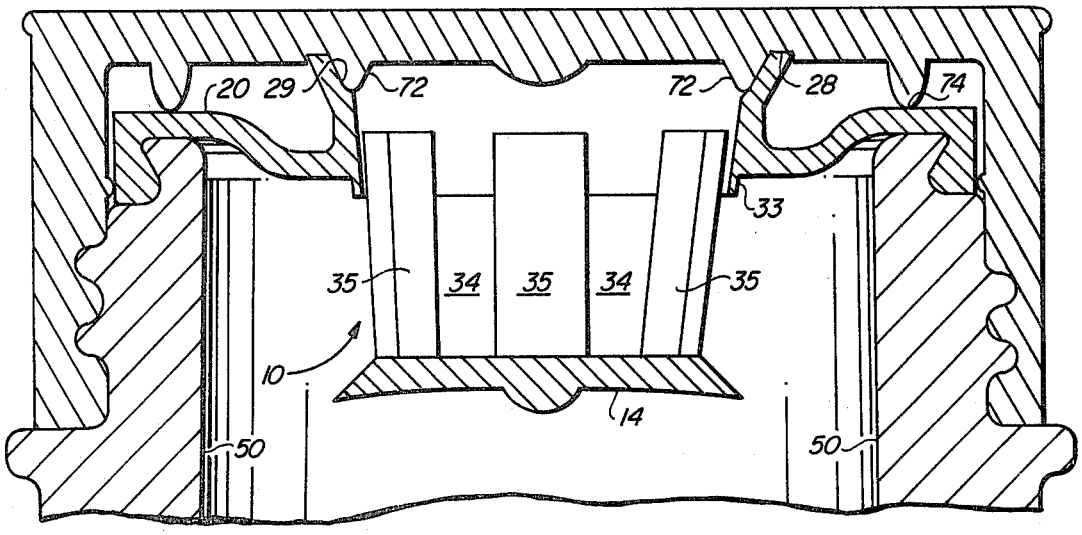
FIG. 4 is a sectional elevational view of the inventive pouring fitment situated within the inventive closure assembly and in place on the neck of a container.

Referring now to FIG. 4, a sectional elevational view of the pouring fitment situated within the closure assembly is shown in place on the neck of a container. As can be seen, with the closure completely screwed down, outward protruding annular shaped ring 72 had deflected flared skirt 29 of pouring fitment 10 outwardly, and now engages annular projection 30 in a sealed manner. Flared skirt 29 fully engages the sloping outside wall of annular ring 72. Second annular ring 74 of closure 60 is pressing tight against the second radially extending flange 20 in a sealing manner, and which in turn is pressing tight against the top annular ring of container 50. Similarily, flat annular radial sealing ring 28 of pouring fitment 10 engages circular groove 73 immediately outward of annular shaped ring 72, also in a sealing manner.

Thus, when the closure is forced down upon the container neck there will be at least four seals between the pouring fitment and the closure as well as the pouring fitment and the container. With the use of a proper flexible material, such as a plastic material, all seals are air-tight as well as liquid-tight. In addition to the seals, the subject invention provides at least two dripless edges as earlier set out, namely, first sharp dripless edge 30 (annular inwardly protruding projection 30) which forms a part of the interior wall of the plenum interiorly to central tubular body 12 of pouring fitment 10; as well as second sharp dripless edge 31 (circular sharp edge 31), the peripheral edge of flat annular radial sealing ring 28 at the very outside rim of the central tubular body 12 of pouring fitment 10.

Figure 5:
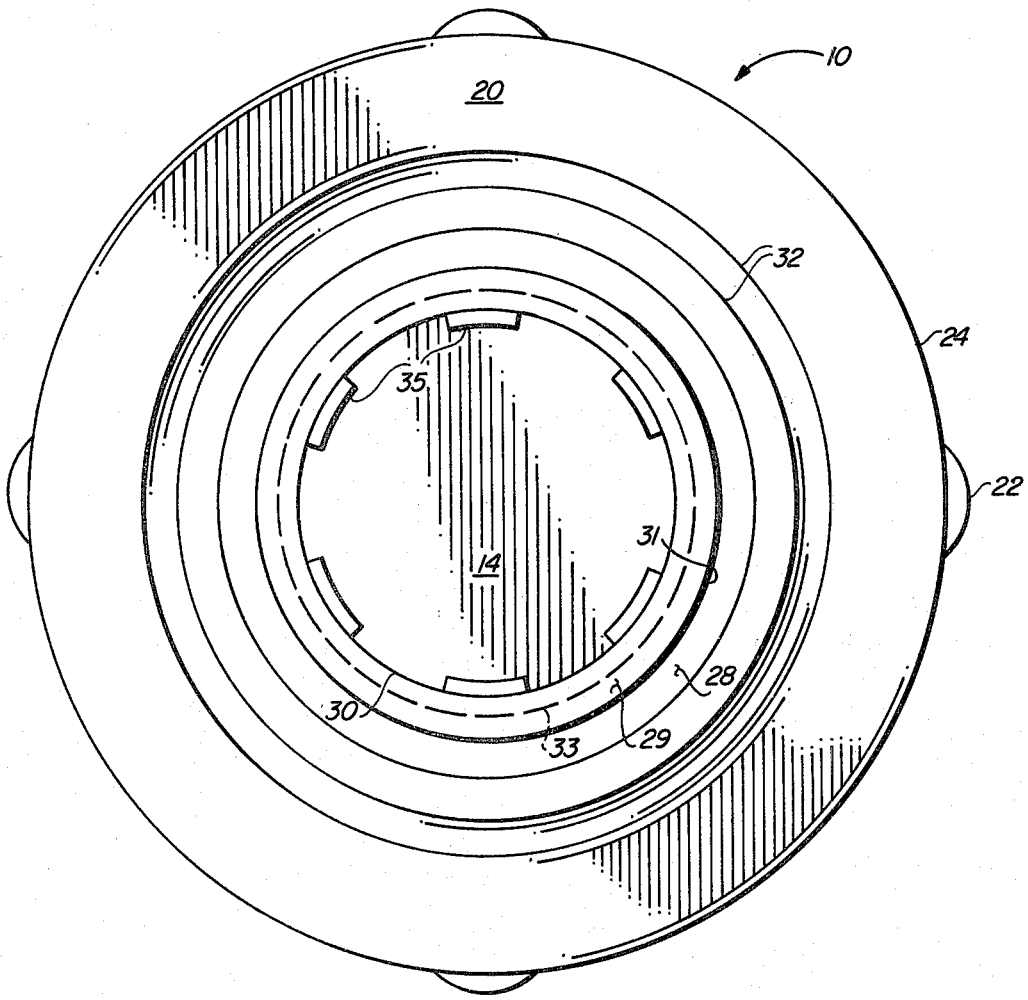
FIG. 5 is a top view of the inventive pouring fitment.

Since it is obvious that closure 60 is to have very little flexibility, if any at all, a hard plastic or similar material is suitable for construction of the closure assembly Referring now to FIG. 5, a top view of pouring fitment 10 is shown, the top view taken as if the pouring fitment were situated onto the neck of a container and viewed from above the container. Proceeding from the outside inward, the largest circular ring is the peripheral joining edge of depending cylindrical skirt 24 and flange 20 to which is attached four outwardly directed lugs 22 adapted to engage the inside cylindrical wall of closure 60 (FIGS. 3 and 4). Any number of lugs 22 greater than two may be utilized including making the lugs continuous all around outer flange 20 to make a circular bead. The radially extending flange 20 is a flat washer-like annular surface terminating at the beginnings of annular well 32 shown with the outside interior wall shading. Here, annular well 32 wall is starting to drop off and to run under the second sharp dripless edge 31 which forms the outside edge of flat annular radial sealing ring 28, shown as an annular washer-like ring. Annular sealing ring 28 terminates with the next inward circle to commence flared skirt 29 which in turn terminates at annular inwardly protruding projection 30 (first sharp dripless edge), the innermost circle. Shown as a dotted line is the inner wall of the cylinder making up the upper portion of the central tubular body 12, which continues smoothly into the inside of circular skirt 33. Located equally around the interior of the cylindrical wall of the upper portion of central tubular body 12 are equally spaced posts 35 which connect the circular end plate 14 shown in the center of FIG. 5 to the upper portion of the central tubular body 12.

The subject inventive pouring fitment has been found useful in adapating to a large variety of different viscous fluids held in containers, from soft drinks, alcoholic beverages, laundry bleach, and the like to rather thick syrups, where the type of liquid delivery discussed above is desired.

While a preferred embodiment of the invention has been shown and described, it would be understood that there is no intent to limit the invention by such disclosure, but rather it is intended to cover all modifications and alternate constructions falling within the spirit and the scope of the invention as defined in the appended claims.

I claim:

1. A pouring fitment for controlling flow of liquid from an associated container comprising a central tubular body for placement in the opening of the associated container, said tubular body open at the outside end and closed by a disk-like end plate at the interior end, said disk-like end plate having a turbulence introducing beveled peripheral edge forming an acute angle, said acute angle directed interiorly to the associated container in order to introduce turbulence into the liquid and slow the liquid as it flows between the end plate beveled edge and the container side; a plurality of ports through said tubular body proximate said end plate; and means adapted to attach said central tubular body to the associated container opening whereby when the associated container holding liquid is up-ended, the liquid in the container flows into said central tubular body through said ports and out said central tubular body open end.

2. The pouring fitment as defined in claim 1 further including a first annular dripless edge comprising a sharpened inward directed protrusion on the inner surface of said central tubular body proximate said open end.

3. The pouring fitment as defined in claim 2 wherein said central tubular body additionally comprises an annular fillet formed in the interior wall of said central tubular body between said first annular dripless edge and said ports of said central tubular body, said annular fillet adapted to receive and puddle the liquid flowing into said ports of said central tubular body.

4. The pouring fitment as defined in claim 3 wherein said central tubular body defines an annular flared skirt joining said first annular dripless edge, said annular flared skirt situated interiorly the open end of said central tubular body whereby liquid on said annular circular beveled skirt will run to said first annular dripless edge and be shed.

5. The pouring fitment as defined in claim 4 wherein said central tubular body defines a top flat annular ring surface joining said annular flared skirt, said top flat annular ring surface comprising the outside end of said central tubular body.

6. The pouring fitment as defined in claim 5 wherein said central tubular body defines a second annular dripless edge, said second annular dripless edge comprising an outwardly directed sharpened edge situated at the central tubular body open end outer periphery and joining said top flat annular ring surface.

7. The pouring fitment as defined in claim 6 wherein said means adapted to attach said central tubular body to the associated container opening defines an inner and an outer annular flange concentrically connected between said central tubular body and the associated container opening, said outer flange including a depending skirt attached thereto at right angles, said depending skirt adapted to encompass in securing relationship the associated container opening top and outer peripheral surface.

8. The pouring fitment as defined in claim 7 wherein said means adapted to attach said central tubular body to the associated container opening inner annular flange comprises an annular well, the annular well having a wall on one side joining said second annular dripless edge, said annular well adapted to receive liquid shed by said second annular dripless edge and to hold such liquid for eventual evaporation.

9. The pouring fitment as defined in claim 8 wherein said means adapted to attach said central tubular body to the associated container opening outer annular flange includes a plurality of outward extending lugs situated at the periphery of said outer annular flange.

10. The pouring fitment as defined in claim 9 wherein said closure defines a cup-like structure having a cylindrical wall and circular bottom, said cylindrical wall threaded in their interior periphery proximate the opening, and including an annular bead protruding inwardly on the interior surface of said cylindrical wall proximate the circular bottom, said inwardly protruding annular bead adapted to hold in place said pouring fitment after said pouring fitment outward extending lugs have been pushed past said closure cylindrical wall annular bead whereby said pouring fitment is kept captive in said closure prior to capping the associated container opening.

11. The pouring fitment as defined in claim 8 further including a closure for capping the associated container opening, said closure adapted to receive and hold in place said pouring fitment for placement upon an associated container opening.

12. The pouring fitment as defined in claim 10 wherein said closure circular bottom comprises in part a central circular area with an annular upward protruding ring concentrically located therein, said annular ring adapted to engage in sealing relationship said first dripless edge of said central tubular body when said closure with said pouring fitment is secured upon the associated container opening.

13. The pouring fitment as defined in claim 12 wherein said annular upward protruding ring defines an outward sloping wall, said outward sloping wall adapted to engage in sealing relationship said flared skirt of said central tubular body when said closure with said pouring fitment is secured upon the associated container opening.

14. The pouring fitment as defined in claim 13 wherein said closure central circular area includes an annular groove outwardly adjacent said annular upward protruding ring, said annular groove adapted to receive in sealing configuration said top flat annular ring surface of said central tubular body when said closure with pouring fitment enclosed is secured upon the associated container opening.

15. The pouring fitment as defined in claim 14 wherein said closure circular bottom additionally defines an upward protruding annular ring outside and concentric said central area, said upward protruding annular ring adapted to engage and seal against said pouring fitment outer flange when said closure and pouring fitment are secured upon an associated container opening.

16. A pouring fitment for controlling flow of liquid from an associated container comprising a central tubular body for placement in the opening of the associated container, said tubular body open at the outside end and closed by an end plate at the interior end, and having a plurality of ports through said tubular body proximate said closed end; a first annular dripless edge comprising a sharpened inward directed protrusion on the inner surface of said central tubular body proximate said open end; an annular fillet formed in the interior wall of said central tubular body between said first annular dripless edge and said ports of said central tubular body, said annular fillet adapted to receive and puddle the liquid flowing into said ports of said central tubular body from the open end thereof; and means adapted to attach said central tubular body to the associated container opening whereby when the associated container holding liquid is up-ended, the liquid in the container flows into said central tubular body through said ports and out said central tubular body open end.

17. A pouring fitment for controlling flow of liquid from an associated container comprising a central tubular body for placement in the opening of the associated container, said tubular body open at the outside end and closed by an end plate at the interior end, and having a plurality of ports through said tubular body proximate said closed end; a top flat annular ring surface comprising the outside end of said central tubular body; an annular dripless edge comprising an outwardly directed sharpened edge situated at the central tubular body open end outer periphery and joining said top flat annular ring surface; means adapted to attach said central tubular body to the associated container opening comprising an inner and an outer annular flange concentrically connected together by an offset between said central tubular body and the associated container opening, said outer flange including a depending skirt attached thereto at right angles, said depending skirt adapted to encompass in securing relationship the associated container opening top and outer peripheral surface, whereby when the associated container holding liquid is up-ended, the liquid in the container flows into said central tubular body through said ports and out said central tubular body open end; an annular well having a wall on one side defined by the exterior of said central tubular body joining said annular dripless edge and on the other side by said offset, said annular well adapted to receive liquid shed by said annular dripless edge and to hold such liquid for eventual evaporation.

* * * * *